United States Patent [19]

Beimesch et al.

[11] Patent Number: 4,992,183

[45] Date of Patent: Feb. 12, 1991

[54] MULTIGRADE HYDROGENATED DECENE-1 OLIGOMER ENGINE OILS

[75] Inventors: Bruce J. Beimesch, Crescent Springs, Ky.; James E. Davis, Loveland, Ohio

[73] Assignee: Ethyl Corporation, Richmond, Va.

[21] Appl. No.: 394,338

[22] Filed: Aug. 15, 1989

Related U.S. Application Data

[63] Continuation-in-part of Ser. 181,132, Apr. 13, 1988, abandoned, which is a continuation of Ser. 33,436, Apr. 1, 1987 abandoned.

[51] Int. Cl.[5] ..... C10M 105/04; C10M 111/02

[52] U.S. Cl. ..... 252/32.7 E; 252/56 S; 252/56 R; 252/51.5 A; 585/10; 585/12

[58] Field of Search ..... 585/10, 12; 252/32.7 E, 252/56 R, 56 S

[56] References Cited

U.S. PATENT DOCUMENTS

| | | | |
|---|---|---|---|
| 3,780,128 | 12/1973 | Shubkin | 585/255 |
| 4,045,507 | 8/1977 | Cupples et al. | 585/517 |
| 4,045,508 | 8/1977 | Cupples et al. | 585/517 |
| 4,218,330 | 8/1980 | Shubkin | 585/255 |
| 4,282,392 | 8/1981 | Cupples et al. | 585/10 |
| 4,319,064 | 3/1982 | Heckelsberg et al. | 585/10 |
| 4,420,646 | 12/1983 | Darden et al. | 585/12 |
| 4,420,647 | 12/1983 | Hammond et al. | 585/12 |
| 4,519,932 | 5/1985 | Schnur et al. | 585/10 |
| 4,587,368 | 5/1986 | Pratt | 585/10 |
| 4,613,712 | 9/1986 | Bridger | 585/10 |
| 4,827,064 | 5/1989 | Wu | 585/12 |
| 4,827,073 | 5/1989 | Wu | 585/17 |
| 4,912,272 | 3/1990 | Wu | 585/12 |

*Primary Examiner*—Olik Chaudhuri
*Assistant Examiner*—Jerry D. Johnson
*Attorney, Agent, or Firm*—Gerald A. Baracka

[57] ABSTRACT

Non-polymer thickened multigrade engine oils based on synthetic basestocks are provided. The SAE 5W-30, SAE 10W-30 and SAE 15W-40 engine oils are derived from hydrogenated decene-1 oligomer mixtures wherein the oligomers range from $C_{30}$ up to $C_{70+}$ and are present in specified proportions. Synthetic esters may be combined with the polyalphaolefin oligomer mixture. The synthetic basestocks are formulated with appropriate performance additives to obtain engine oils which meet the desired API Service Requirements for gasoline and/or diesel engine usage. In addition to specified oligomer distributions, the polyalphaolefins have specified viscosities, molecular weights and branching.

29 Claims, No Drawings

MULTIGRADE HYDROGENATED DECENE-1 OLIGOMER ENGINE OILS

CROSS-REFERENCE TO RELATED APPLICATIONS

This is a continuation-in-part of co-pending application Ser. No. 07/181,132, filed Apr. 13, 1988, now abandoned, which is a continuation of application Ser. No. 07/033,436, filed Apr. 1, 1987, now abandoned.

BACKGROUND OF THE INVENTION

Field of the Invention

The present invention relates to non-polymer thickened multigrade engine oils based on synthetic hydrocarbons. More specifically, SAE 5W-30, SAE 10W-30 and SAE 15W-40 engine oils derived from hydrogenated decene-1 oligomers and which do not contain viscosity index improvers are provided.

Description of the Prior Art

SAE 10W-30 is probably the engine oil viscosity grade most widely recommended by manufacturers for gasoline passenger car service. SAE 5W-30 engine oils for gasoline passenger car service have in recent years also been gaining in use. For diesel truck operation, SAE 15W-40 is the most widely recommended engine oil viscosity grade.

All of the above oils are multigrade or cross-graded which, in general terms, means that they are acceptable for use in either a summer or winter environment. More precisely, these oils must meet the SAE J300 JUN87 specifications. For an SAE 10W-30 oil, this means that the oil has a viscosity of 3500 centipoise or below at −20°C. as determined in accordance with ASTM D-2602 and a viscosity between 9.3 and 12.5 centistokes at 100°C. as determined in accordance with ASTM D-445. Additionally, the formulated oil would have a borderline pumping temperature (ASTM D-3829) of −25°C. or below and a stable pour point (FTMS 791b-203) of −30°C. or below. SAE 15W-40 oils would have a maximum viscosity of 3500 centipoise at −15°C., a viscosity between 12.5 and 16.3 at 100°C., borderline pumping temperature of −20°C. or below, and a stable pour point of −25°C. or below. Similar viscosity specifications are defined by SAE J300 JUN87 for 5W-30 oils and for other multigrade oils.

In addition to satisfying the viscosity criteria, multigrade engine oils must also meet certain service classifications of the American Petroleum Institute (API). This is accomplished by the addition of appropriate performance additives to the oil. It should be noted that it is the formulated oil, i.e. the base oil with all of the performance additives, which must meet the SAE J300 JUN87 viscosity criteria.

To obtain multigrade motor oils using petroleum base stocks, it is also necessary to add a viscosity index (VI) improver. VI improvers are polymeric materials, such as ethylene-propylene copolymers, hydrogenated styrene-diene block copolymers, polyalkyl methacrylates, polyisobutylenes, ethylene-vinyl acetate copolymers or the like, which modify the rate of change of viscosity of the basestock with temperature when added thereto. While the polymeric VI improvers are necessary to achieve cross-grading with petroleum basestocks, the addition of these polymers is not without problem.

It is well documented in the prior art that the high molecular weight polymeric VI improvers can undergo shear, i.e., breakdown, under conditions of thermal and mechanical stress. Breakdown of the VI improver alters the viscosity characteristics of the formulated motor oil and can also contribute to the formation of sludge and engine deposits. Field studies have shown, for example, that a SAE 15W-40 diesel engine oil can drop to SAE 15W-30 after only several thousand miles of service. This presents a very real problem with heavy duty over-the-road trucks where it is not uncommon to accumulate 30,000 miles between service intervals. Breakdown of VI improvers is also a problem with gasoline engines, particularly in view of the longer drain intervals which are now being promoted and the fact that today's smaller engines operate at higher RPM's and higher temperatures. The general problems associated with the breakdown of polymeric VI improvers is discussed by W. Wunderlich and H. Jost in their entitled "Polymer Stability in Engines", Society of Automotive Engineers, Inc. SAE-429, Paper No. 780372.

One approach to overcoming the problems associated with the use of VI improvers is to develop improved polymers which are more resistant to shear under conditions of thermal and mechanical stress. While the development of new polymeric thickeners is a viable approach, it would be even more desirable and advantageous if VI improvers could be totally eliminated from multigrade motor oil formulations.

European Pat. application Nos. 88,453; 119,069; and 119,070 disclose multigrade lubricants which are combinations of synthetic fluids having different viscosities. The lubricants consist of blends of high viscosity ethylene-alphaolefin copolymers with lower viscosity synthetic hydrocarbons, such as an alkylated benzene or polyalphaolefin, or ester, such as a monoester, diester or polyester. 5W-40 and 10W-40 oils indicated as being suitable for use as diesel crankcase lubricants obtained by blending different synthetic products are disclosed.

U.S. Pat. No. to R.E. Pratt discloses base oils for motor oil uses comprised predominantly of tetramer (C40) and pentamer ($C_{50}$) fractions. U.S. Pat. No. 4,282,392 to Cupples et al discloses hydrogenated mixtures of 1-decene oligomers with improved viscosity-volatility properties by virtue of high proportions of tetramer. There is no indication in either of the references to the preparation of multrigrade engine oils.

It would be highly desirable and advantageous if multigrade engine oils suitable for most passenger car and diesel truck service could be obtained using a synthetic hydrocarbon basestock without a VI improver. This would preclude compatability problems and eliminate the heretofore described breakdown problems caused by high shear conditions.

SUMMARY OF THE INVENTION

We have now produced SAE 5W-30, SAE 10W-30 and SAE 15W-40 motor oils from synthetic hydrocarbon basestocks without the addition of VI improvers. The multigrade engine oils of the invention are produced using specific mixtures of oligomers of decene-1 with performance additives which meet the desired API service classification.

For the multigrade non-polymer thickened lubricants of this invention, significant amounts of hydrogenated hexamer ($C_{60}$ oligomer), heptamer ($C_{70}$ oligomer) and higher decene-1 oligomers are present with hydrogenated trimer ($C_{30}$ oligomer), tetramer ($C_{40}$ oligomer) and pentamer ($C_{50}$ oligomer). These compositions are obtained by judicious blending of fractions having different oligomer distributions or directly produced by the oligomerization of decene-1 by proper design and control of process equipment. In addition to having specified oligomer distributions, the weight average molecular weight and amount of branching of the oligomers, i.e. the percentage of hydrogen atoms of the oligomers which are methyl hydrogens, must also fall within specified limits.

More specifically, the non-polymer thickened SAE 5W-30, 10W-30 and 15W-40 universal engine oils are comprised of 80% to 90% by weight synthetic basestock of specified kinematic viscosity (100°C.) and 10% to 20% by weight performance additives such that the formulated oil meets the appropriate API Service Requirements. The non-polymer thickened SAE 10W-30 gasoline engine oils are comprised of 90% to 95% by weight synthetic basestock of specified kinematic viscosity (100°C.) and 5% to 10% by weight performance additives such that the formulated oils meets the appropriate API Service Requirements. Synthetic basestocks which are used may be comprised solely of decene-1 oligomers or may be a blend of decene-1 oligomers with synthetic esters. In the latter case, the basestock will contain 70% to 95% of the hydrogenated decene-1 oligomer mixture and 5% to 30% of a synthetic ester selected from the group consisting of esters of adipic or azelaic acid with $C_{8-13}$ monofunctional aliphatic alcohols or esters of $C_{5-10}$ aliphatic monocarboxylic acids with trimethylolpropane or pentaerythritol. Basestock viscosities (100°C.) for the various formulations are as follows:

SAE 10W-30 Universal - 7.2 to 9.1 centistokes
SAE 10W-30 Gasoline - 7.9 to 9.9 centistokes
SAE 15W-40 Universal - 9.9 to 12.5 centistokes
SAE 5W-30 Universal - 7.1 to 7.3 centistokes For the SAE 10W-30 non-polymer thickened universal engine oils the polyalphaolefin (mixed hydrogenated decene-1 oligomers) will have a weight average molecular weight of 559 to 750 with 19.8% to 24.2% of the hydrogen atoms of the oligomers being methyl hydrogens and contain 0.2% to 13.5% $C_{30}$ oligomer, 20% to 64% $C_{40}$ oligomer, 17% to 39% $C_{50}$ oligomer, 6% to 27.5% $C_{60}$ oligomer and 1% to 13.5% $C_{70+}$ oligomer.

Non-polymer thickened SAE 10W-30 gasoline engine oils utilize hydrogenated decene-1 oligomer mixtures which will have a weight average molecular weight of 623 to 702 with 19.8% to 20.9% of the hydrogen atoms of the oligomers being methyl hydrogens and which contain 0.2% to 21% $C_{30}$ oligomer, 31% to 62.5% $C_{40}$ oligomer, 18% to 35.5% $C_{50}$ oligomer, 7.5% to 14% $C_{60}$ oligomer and 7% to 14% $C_{70+}$ oligomer.

For the non-polymer thickened SAE 15W-40 universal engine oils the mixture of hydrogenated decene-1 oligomer will have a weight average molecular weight of 673 to 798 with 20.2% to 24.7% of the hydrogen atoms of the oligomers being methyl hydrogens and contain up to 2% $C_{30}$ oligomer, 5% to 51.5% $C_{40}$ oligomer, 27% to 44.5% $C_{50}$ oligomer, 10.5% to 34.5% $C_{60}$ oligomer and 9.5% to 20% $C_{70+}$ oligomer.

The SAE 5W-30 non-polymer thickened universal engine oils employ the hydrogenated decene-1 oligomer mixtures which have a weight average molecular weight of 550 to 570 with 19.8% to 20.2% of the hydrogen atoms of the oligomers being methyl hydrogens and which contain 12.5% to 13.5% $C_{30}$ oligomer, 43% to 47% $C_{40}$ oligomer, 28.5% to 30.5% $C_{50}$ oligomer, 9% to 10% $C_{60}$ oligomer and 2.4% to 3.5% $C_{70+}$ oligomer.

DETAILED DESCRIPTION OF THE INVENTION

In accordance with the present invention, cross-graded motor oils suitable for passenger car and diesel truck service are obtained using a synthetic hydrocarbon basestock, namely, polyalphaolefins comprised of specific decene-1 oligomers present in specified amounts. Synthetic esters may be employed in conjunction with the polyalphaolefin. The multigrade engine oils of the invention are obtained without the use of polymeric VI improvers. SAE 5W-30, SAE 10W-30 and SAE 15W-40 engine oils can be produced simply by addition of the appropriate performance additives, i.e., additives which meet the designated API service classification, to the synthetic hydrocarbon basestock.

Synthetic lubricants derived from alpha-olefins and processes for their production are well known. The polyalphaolefins are obtained using conventional polymerization techniques such as those described in U.S. Pat. Nos. 3,149,178; 3,763,244; 3,780,128; 4,045,508; and 4,239,920. The processes for oligomerizing alpha-olefins, such as octene-1 or decene-1, generally use a a boron trifluoride catalyst in combination with a promoter, such as alcohol or water. Such oligomerization processes yield oligomer mixtures —— the exact oligomer distribution depending on reaction conditions. Heretofore, oligomers above pentamer have typically been produced in such small amounts that they very often are not even been reported.

As a result of changes in reactor design and better control of process conditions, it is now possible to produce polyalphaolefin products which contain substantial amounts of higher decene-1 oligomers and oligomers having substantially reduced levels of isomerization. For example, products containing 20% or more hexamer, heptamer and higher oligomers and wherein the degree of branching of the oligomers is reduced can consistently be obtained from decene-1 oligomerization processes. In accordance with the present invention, it has now been found that oligomer mixtures containing substantial amounts of these higher oligomers can be formulated with suitable performance additives to yield multigrade engine oils without the addition of polymeric viscosity index improvers. SAE 5W-30, SAE 10W-30 and SAE 15W-40 engine oils, the principal viscosity grades recommended for most passenger car and diesel truck service, can be obtained in this manner.

For this invention, specific mixtures of decene-1 oligomers, also referred to herein as oligomer composite(s), which contain substantial amounts of $C_{60}$ and higher oligomers are employed. The useful oligomer mixtures are obtained by oligomerizing decene-1 using an alcohol-promoted boron trifluoride catalyst in accordance with the conventional procedures known to the art. It is especially advantageous for the present invention to utilize oligomer mixtures obtained from the oligomerization of decene-1 wherein the catalyst is boron trifluoride promoted with propanol It will, however, be understood by those skilled in the art that any oligomerization procedure whereby compositions having the hereinafter specified oligomer distributions and characteristics can be employed. Similarly, whereas all of the oligomeric composites utilized herein are mixtures of decene-1 oligomers, oligomeric products derived from other alpha-olefins in the $C_{8-12}$ range can also be utilized. The ranges specified herein for the oligomer mixtures derived from decene-1 will not, however, apply to oligomers derived from other olefins.

It is possible to obtain the useful oligomer mixture directly from the reactor without further blending. This can be accomplished by controlling the reaction conditions and by proper reactor design. One or more distillation operations may be necessary to achieve the desired oligomer distribution. Also, as with all alpha-olefin derived oligomers used for lubrication applications, the oligomer mixture should be hydrogenated prior to use in order to obtain optimum oxidative and thermal stability.

More generally, the oligomer composite utilized as the basestock to obtain the multigrade engine oils of the invention are blends of two or more fractions having different oligomer distributions. A fraction rich in lower oligomers is typically blended with a fraction rich in higher oligomers to achieve the desired oligomer distribution; however, any combination of fractions which will yield a composite having the required distribution of oligomers is acceptable. The fractions employed for such blending may be different distillation cuts from the same process or may be obtained from entirely different oligomerization processes. A single fraction may be used to produce different multigrade oils, e.g. SAE 10W-30 and SAE 15W-40 oils. For example, a fraction rich in higher oligomers can be blended in one operation with a first fraction rich in lower oligomers to obtain a mixture suitable as a basestock for SAE 10W-30 usage and in another operation with a different lower-oligomer-rich fraction to produce a composite acceptable as a basestock for SAE 15W-40 oils. If the same lower-oligomer-rich fraction is employed, it is apparent that the proportions of the fractions must be different to produce SAE 10W-30 and SAE 15W-40 oils or that a different high-oligomer-rich fraction must be used. The composite obtained after blending can be hydrogenated or the individual fractions can be hydrogenated before they are blended.

The oligomers are hydrogenated using conventional method known to the art which typically involve combining the oligomer with a suitable hydrogenation catalyst and pressurizing with hydrogen at an elevated temperature. Conventional catalysts, such as platinum or palladium supported on charcoal, Raney nickel, nickel on kieselguhr, and the like, are employed. Pressures can range from about several hundred psig up to about 2000 psig and temperatures range from about 50°C. to about 300°C. The hydrogenation is terminated when the desired bromine number is achieved, typically less than 1.

In addition to specified oligomer distributions, which will be defined for each of the engine oils in more detail to follow, the degree of branching of the oligomers and the weight average molecular weight ($\overline{Mw}$) must also fall within prescribed ranges. For the purpose of this invention, the degree of branching is indicated by determining (by proton nuclear magnetic resonance spectroscopy) the % of hydrogen atoms which are associated with methyl groups, i.e., the contribution of hydrogens from methyl groups versus the total hydrogens. Synthetic basestocks of specified viscosity (100°C. Kinematic) and having specific oligomer distributions and characteristics are necessary if engine oils which are cross-graded without the addition of VI improvers are to be obtained. Additionally, performance additives must be included in the formulation to obtain the desired service rating. An SAE 5W-30, SAE 10W-30 or SAE 15W-40 engine oil which meets the manufacturer's specifications therefore requires both the proper selection of oligomers and additives —— the oligomer combination to impart the desired viscometrics and the performance additives to impart the necessary service characteristics. Acceptable formulations are not produced if either the synthetic basestock or the performance additives does not meet the required specifications.

While SAE 5W-30, SAE 10W-30 and SAE 15W-40 are the specific multigrade formulations defined, it will be understood by those skilled in the art that narrower multigrade oils within the broader viscosity range are also possible. For example, SAE 15W-30 and SAE 10W-20 formulations can also be obtained and are within the scope of SAE 10W-30 even though the former grades are not specifically referenced. This aspect of the invention can be better understood by reference to the table which follows wherein the viscosity requirements for engine oils defined by SAE Engine Oil Viscosity Classification —— SAE J300 JUN87 are provided.

| SAE Viscosity Grade | 100° C. Kinematic Viscosity (cSt)[1] Min. | Max. | Maximum Viscosity (Centipoise) at Temperature (°C.)[2] | Maximum Borderline Pumping Temperature[3] |
|---|---|---|---|---|
| 0W | 3.8 | — | 3250 at −30 | −35° C. |
| 5W | 3.8 | — | 3500 at −25 | −30° C. |
| 10W | 4.1 | — | 3500 at −20 | −25° C. |
| 15W | 5.6 | — | 3500 at −15 | −20° C. |
| 20W | 5.6 | — | 4500 at −10 | −15° C. |
| 25W | 9.3 | — | 6000 at −5 | −10° C. |
| 20 | 5.6 | <9.3 | | |
| 30 | 9.3 | <12.5 | | |
| 40 | 12.5 | <16.3 | | |
| 50 | 16.3 | <21.9 | | |

[1]ASTM D-445
[2]Cold Cranking Simulator (CCS) ASTM D-2602; simulates engine-cranking characteristics of an oil between −40° C. and 0° C. and at high shear.
[3]For SAE 0W, 20W and 25W oils, BPT is measured using ASTM D-3829 or CEC L-32-T-82; for SAE 5W, 10W and 15W oils, BPT is measured according to procedure ASTM D-4684.

Two series of viscosity grades are defined in the table — those which contain the letter W and those without such letter. Viscosity grades with the letter W have maximum CCS low-temperature viscosity and a maximum borderline pumping temperature requirements in addition to the 100°C. kinematic viscosity requirements whereas the non-W grades only have 100°C. kinematic viscosity specifications. In accordance with the SAE standard, a multigrade or cross-graded oil is defined as one whose low-temperature viscosity (CCS) and borderline pumping (BPT) satisfies the requirements for one of the W grades and whose 100°C. kinematic viscosity is within the prescribed range of one of the non-W graded oils.

In one embodiment of the invention SAE 10W-30 engine oils which do not contain polymeric viscosity index improvers and which meet the appropriate API "S" Service Classification for gasoline engines are provided. These Service Categories include, most notably, SC, SD, SE, SF and SG. Oils meeting API Service Classification SG are the most important since they may also be used where API Service Categories SF, SE, SD or SC are recommended. Thus, where a specific Service Category is referred to herein, all prior Service Categories which have less stringent engine test requirements are also included.

The SAE 10W-30 engine oils suitable for use in gasoline engines contain 5% to 10% by weight gasoline engine performance additives so that the oil meets the API "S" Service requirements and 90% to 95% by weight of a synthetic basestock having a 100°C. kinematic viscosity of 7.9 to 9.9 centistokes. Hydrogenated decene-1 oligomers which comprise the synthetic basestock contain 0.2% to 21% $C_{30}$ oligomer, 31% to 62.5% $C_{40}$ oligomer, 18% to 35.5% $C_{50}$ oligomer, 7% to 14% $C_{60}$ oligomer and 2.5% to 14% $C_{70+}$ oligomers. Percentages reported herein for oligomers are area percentages determined by conventional gas-liquid chromatographic methods. Additionally the oligomers will have a Mw of 623 to 702 with 19.8% to 20.9% of the hydrogen atoms being methyl hydrogens. This latter value defines the degree of oligomer branching and is determined by proton nuclear magnetic resonance (NMR) analysis.

Generally, these engine oils are formulated with a performance additive package which meets the desired API "S" Service Rating, most typically, API Service Rating SG. Performance additive packages are commercially available and widely used in the manufacture of engine oils. These packages are formulated to contain the necessary corrosion inhibitors, detergents, dispersants, antiwear additives, defoamers, antioxidants, metal passivators and other adjuvants required to obtain a useful motor oil of the desired quality, i.e., to meet the desired API Service Rating. The use of these additive packages greatly simplifies the task of the formulator.

Especially useful SAE 10W-30 engine oils suitable for use in gasoline engines are obtained using a polyalphaolefin basestock wherein the distribution of oligomers is as follows: 1.5% to 20.5% $C_{30}$ oligomer, 31% to 48.5% $C_{40}$ oligomer, 27.5% to 35.5% $C_{50}$ oligomer, 8% to 14% $C_{60}$ oligomer and 3.0% to 13% $C_{70+}$ oligomer. It is particularly advantageous if the $\overline{Mw}$ of the oligomer mixture is 643 to 702 and the percentage of methyl hydrogens ranges from 19.8 to 20.3.

In another embodiment of this invention non-polymer thickened SAE 10W-3 engine oils suitable for use in diesel engines, i.e., meeting the appropriate API "C" Commercial Classification, are also provided. The most common oils of this type are those having API Service Ratings CD and CE. In addition to meeting the service requirements for diesel engines, these same SAE 10W-30 oils can also meet API "S" gasoline service requirements in which case they are referred to as "dual service" or "universal" engine oils. Universal engine oils can have API Service Designations CD/SD, CD/SE, CC/SE, CC/SF, CD/SF, CE/SG, etc., and are widely used by individuals with mixed fleets, i.e., gasoline engine vehicles and lighter duty diesel engine vehicles. This facilitates servicing since only one engine oil suitable for use in both types of vehicles need be inventoried. The SAE 10W-30 universal engine oils of this invention contain 10% to 20% by weight performance additives so that the formulated oil meets the appropriate API "C" or "S" and "C" Service requirements and 80% to 90% by weight of a synthetic basestock having a 100°C. kinematic viscosity of 7.2 to 9.1 centistokes. Hydrogenated decene-1 oligomer mixtures useful for this purpose contain 0.2% to 13.5% $C_{30}$ oligomer, 20% to 64% $C_{40}$ oligomer, 17% to 39% $C_{50}$ oligomer, 6% to 27.5% $C_{60}$ oligomer, and 1% to 13.5% $C_{70+}$ oligomers and have a $\overline{Mw}$ of 560 to 750 with 19.8% to 24.2% of the hydrogen atoms being methyl hydrogens. Most advantageously, the oligomer mixture will contain 3% to 13% $C_{30}$ oligomer, 42% to 44.5% $C_{40}$ oligomer, 29% to 34.5% $C_{50}$ oligomer, 9.5% to 12% $C_{60}$ oligomer, and 2.5% to 8% $C_{70+}$ oligomers. Oligomer mixtures with weight average molecular weights of 559 to 672 and with 19.8% to 20.5% of the hydrogens being methyl hydrogens are especially useful basestocks for the formulation of the SAE 10W-30 universal engine oils of this invention.

In yet another embodiment of this invention, non-polymer thickened SAE 15W-40 universal engine oils are contemplated. These oils, which are typically recommended for heavier duty usage, contain from 10% to 20% by weight of the appropriate performance additives so that the formulated oil meets the desired API "C" Service Rating or API "S" and "C" with 80% to 90% by weight of a synthetic basestock of 100°C. kinematic viscosity 9.7 to 12.5 centistokes and, more preferably, 9.7 to 11 centistokes. Hydrogenated decene-1 oligomer mixtures useful for this formulation contain up to 2% $C_{30}$ oligomer, 5% to 51.5% $C_{40}$ oligomer, 27% to 44.5% $C_{50}$ oligomer, 10.5% to 34.5% $C_{60}$ oligomer, and 9.5% to 20% $C_{70+}$ oligomers. They further have weight average molecular weights of 680 to 798 with methyl hydrogen percentages from 20.2 to 24.7. Most typically, the oligomer composite will contain from 1% to 1.9% $C_{30}$ oligomer, 18.5% to 42.5% $C_{40}$ oligomer, 29% to 44.5% $C_{50}$ oligomer, 11.5% to 19% $C_{60}$ oligomer, and 9.5% to 18% $C_{70+}$ oligomers and have a $\overline{Mw}$ of 673 to 720 with 20.2 to 21% of the hydrogen atoms of the oligomers being methyl hydrogens.

All of the foregoing engine oils, i.e. the SAE 10W-30 gasoline engine oils and the SAE 10W-30 and SAE 15W-40 universal engine oils, can utilize a synthetic basestock which is a blend of the above-prescribed polyalphaolefin oligomers with one or more synthetic esters. Where such polyalphaolefin/ester blends are used the hydrogenated decene-1 oligomer mixture constitutes 70% to 95% by weight of the blend and the synthetic ester constitutes from 5% to 30% of the blend. Useful synthetic esters include esters of adipic acid or azelaic acid with $C_{8-13}$ monofunctional aliphatic monoalcohols and esters of $C_{5-10}$ aliphatic monocarboxylic acids with trimethylolpropane or pentaerythritol. Representative esters which can be utilized include: diisodecyl adipate, diisodecyl azelate, di-2-ethylhexyl adipate, di-2-ethylhexyl azelate, diisotridecyl adipate, diisotridecyl azelate, pentaerythritol tetraheptanoate and the like.

Engine oils formulated utilizing polyalphaolefin/-ester blends as the basestock are particularly advantageous where improved elastomer compatability/seal swell and improved dispersancy/detergency are required. In one embodiment of this invention, the synthetic basestock is comprised of an 85% to 90% polyalphaolefin oligomer mixture with 5% to 15% by weight of a diester of adipic or azelaic acid with isodecyl alcohol, tridecyl alcohol or 2-ethylhexanol.

In accordance with this invention, there is also provided an SAE 5W-30 universal engine oil which contains no polymeric VI improvers and comprised of 80% to 90% by weight of a synthetic basestock having a 100°C. kinematic viscosity in the range 7.1 to 7.3 centistokes and 10% to 20% by weight universal engine performance additives such that the formulated oil meets API "C" Service Requirements or API "S" and API "C" Service Requirements. The synthetic basestock utilized for this SAE 5W-30 universal engine oil is a mixture of hydrogenated decene-1 oligomers having a weight average molecular weight of 550 to 570 with 19.8% to 20.2% of the hydrogen atoms of the oligomers being methyl hydrogens. The oligomer distribution for the polyalphaolefin is as follows: 12.5% to 13.5% $C_{30}$ oligomer; 43% to 47% $C_{40}$ oligomer; 28.5% to 30.5% $C_{50}$ oligomer; 9% to 10% $C_{60}$ oligomer and 2.5% to 3.5% $C_{70+}$ oligomer.

As previously indicated, the performance additives are most generally incorporated into the oil by the addition of an available additive package. The oil may, however, be formulated by the addition of the individual additive components. In either case the result is the same, that is, the engine oil contains the requisite amount of the necessary additives to achieve the desired API Services Rating. The useful additive packages and the individual additives are known and commercially available.

Commercial additive packages are formulated to contain the necessary detergents, dispersants, corrosion/rust inhibitors, antioxidants, antiwear additives, defoamers, metal passivators, set point reducers, and the like to meet a specific API Service Rating when employed at the recommended usage level. They do not, however, contain viscosity index improvers. While it is not generally necessary, additional additives may be employed in conjunction with these additive packages.

Most additive manufacturers supply a line of additive packages to meet the full range of service requirements for gasoline engine oils, diesel engine oils, and universal oils. For example, Ethyl Petroleum Additives Division provides a complete line of products which are sold under the trademark HiTEC. The following is a list of the various HiTEC additive packages and the recommended API Service Rating for each: HiTEC 918 - SF, HiTEC 991-SC, HiTEC 850C - CD, HiTEC 909 SF/CC, HiTEC 910 - SF/CC, HiTEC 914 - SF/CC, HiTEC 920 - SF/CC, HiTEC 2000 - SF/CC, HiTEC 2001 - SF/CD, HiTEC 854 - SF/CD, HiTEC 861 - SF/CD, HiTEC 862 -SF/CD, HiTEC 865 - SF/CD and HiTEC 995 - SG/CD. Similar additive packages are available from other manufacturers. For example, the following are representative universal additive packages: TLA-654A (SF/CD), TLA-668 (SF/CC), and TLA-679 (SF/CD) manufactured by Texaco Chemical Company; OLOA 8150A (SF/CD) OLOA8177 (SG/CE), OLOA 8363C (SF/CC), OLOA 8373 (SF/CC), OLOA 8718 (SF/CD), and OLOA 8730 (SF/CD) manufactured by Chevron Chemical Company, Oronite Additives Division; Lubrizol (trademark) 7574 (SF/CC), 3978 (SF/CD) and 8881 (SG/CD) manufactured by The Lubrizol Corporation; and Amoco (trademark) 6688 (SF/CD), 6689 (SF/CD), 6817 (SF/CC), 6831 (SF/CC), 6881 (SG/CE) and 6894 (SG/CE) manufactured by Amoco Petroleum Additives Company. Other additive packages with different API service ratings are available from the aforementioned manufacturers and other suppliers.

The dosage level employed will vary depending on the particular additive package used. For example, optimal usage levels for SAE 15W-40 engine oils with the five HiTEC SF/CD rated packages range from about 11.5 percent to 14.7 percent. Variations in oligomer distribution may require adjustments of the dosage level even within the same SAE grade. Even when an additive package is employed for the formulation, one or more other additives may still be employed.

If desired, individual additive components including known antioxidants, dispersants, detergents, metal passivators, rust/corrosion inhibitors, setting point reducers, friction reducing agents and the like can be compounded with the oligomer composite to obtain the engine oil. Useful antioxidants include substituted aromatic amines, such as dioctyldiphenylamine, mono-t-octylphenylnaphthylamines, dioctylphenothiazine, phenyl-naphthylamine, N,N'-di-butyl-p-phenylenediamine and the like; hindered phenols, such as 2,6-di-t-butyl-p-cresol, 4,4'-bis-(2,6-diisopropylphenol), 2,2'-thio-bis-(4-methyl-6-t-butylphenol), 4,4'-methylene-bis-(2,6-di-t-butylphenol); organic phosphites, such as trinonyl phosphite, triphenyl phosphite, and the like; esters of thiodipropionic acid, such as dilauryl thiodipropionate; and the like.

Representative detergents and dispersants include polyalkenylsuccinimides and oil-soluble metal soaps, such as Ca, Ba, Mg and Al carboxylates, phenates and sulfonates.

Useful metal passivators include benzotriazole, 2-mercaptobenzotriazole, 2,5-dimercaptothiadiazole, salts of salicylaminoguanidine, quinizarin, propyl gallate, and the like.

Useful rust/corrosion inhibitors include primary, secondary or tertiary aliphatic or cycloaliphatic amines and amine salts of organic and inorganic acids; oil-soluble alkylammonium carboxylates; substituted imidazolines and oxazolines; alkali metal and alkaline earth metal carbonates; alkali metal and alkaline earth metal salts of alkylbenzene sulfonic acids, such as barium dinonylnaphthalenesulfonates, calcium petroleumsulfonates, and the like; esters, anhydrides, and metal salts of organic acids, such as sorbitan monooleate, lead naphthenate, and dodecylsuccinic anhydride; and the like.

Set point reducers can include alkylated naphthalenes, alkylated phenols, polymethacrylates and the like. Anti-wear additives can include sulfur, phosphorus, and halogen-containing compounds, such as sulfurized vegetable oils, zinc dialkyl dithiophosphates, chlorinated paraffins, alkyl and aryl disulfides, and the like. Multifunctional additives such as those described in U.S. Pat. Nos. 3,652,410, 4,162,224, and 4,534,872 can also be utilized for the formulation of these engine oils.

The amount of the individual additives will vary and is dictated by the particular application and the service requirement desired. The total amount of the additives, however, falls within the above-prescribed weight percent limits specified for each of the engine oils.

The following examples illustrate the non-VI improved multigrade engine oil formulations of the present invention more fully. In these examples all parts are on a weight basis unless otherwise indicated. The polyalphaolefins used for the formulation of these engine oils were hydrogenated decene-1 oligomer mixtures. Oligomer distributions were determined by conventional gas-liquid chromatographic (GLC) methods using a glass capillary column. Separation of decene-1 oligomers above $C_{70}$ is not possible employing this technique. For this reason, the last oligomer fraction is reported as $C_{70+}$ since it may also contain small amounts of oligomers higher than $C_{70}$, primarily $C_{80}$ and $C_{90}$ oligomers. Oligomer distributions are reported throughout as area percentages. $\overline{Mw}$ is calculated from the weight percentages of the various oligomers as determined by GLC. Conventional proton NMR techniques were utilized to determine the percentage of methyl hydrogens.

Viscosities reported were determined per the SAE J300 JUN87 specifications. CCS viscosities are reported in centipoise at the specified temperatures (°C.) whereas all 100°C. kinematic viscosities are reported in centistokes.

In addition to abbreviations noted in the foregoing description, the following additional abbreviations are used in some of the tables:

100°C. Vis - 100°C. Kinematic Viscosity

% Me H - Percentage of Methyl Hydrogen

EXAMPLE I

A non-polymer thickened SAE 10W-30 gasoline engine oil having an API Service Rating SF was prepared using a mixture of hydrogenated decene-1 oligomers. The oligomer composite employed as the basestock was obtained by blending two different polyalphaolefin synthetic hydrocarbon fluids. The first fluid contained 4.8 percent $C_{30}$ oligomer, 63.7 percent $C_{40}$ oligomer, 18.7 percent $C_{50}$ oligomer, 6.5 percent $C_{60}$ oligomer, and 6.3 percent $C_{70+}$ oligomer. The second fluid, which contained significantly higher amounts of the higher oligomers, contained 54.7 percent $C_{40}$ oligomer, 24.5 percent $C_{50}$ oligomer, 10.0 percent $C_{60}$ oligomer, and 10.8 percent $C_{70+}$ oligomers. The first and second fractions were blended at a 1:1 ratio to produce an oligomer mixture (100°C. Kinematic viscosity 8.75 centistokes) containing 2.40 percent $C_{30}$ oligomer, 59.2 percent $C_{40}$ oligomer, 21.6 percent $C_{50}$ oligomer, 8.3 percent $C_{60}$ oligomer, and 8.6 percent $C_{70+}$ oligomer. The $\overline{Mw}$ of the mixture was 648.2 with 20.3% of the hydrogens being methyl hydrogens. The oligomer mixture (92.20 parts) was combined with 7.80 parts low ash gasoline engine performance additive package (Lubrizol (trademark) 7574] meeting API SF requirements. The resulting formulated oil had a 100°C. viscosity of 10.09 centistokes and CCS viscosity at −20°C. of 3290 centipoise. The oil also met the Borderline Pumping Temperature requirements and stable pour point requirements of SAE J300 JUN87 for SAE grade 10W, thus fully qualifying it as a cross-graded 10W-30 SF engine oil.

EXAMPLE II

To further demonstrate the ability to obtain an SAE 10W-30 engine oil an oligomer composite was prepared by blending the polyalphaolefin synthetic hydrocarbon fluids of Example I in a ratio of 3.5:1. The resulting basestock had a 100°C. kinematic viscosity of 8.20 centistokes, $\overline{Mw}$ of 639.8 and 20.1% of the hydrogens were methyl hydrogens. Ninety parts of the resulting oligomer composite (3.73% $C_{30}$ oligomer, 61.40% $C_{40}$ oligomer, 19.70% $C_{50}$ oligomer, 7.06% $C_{60}$ oligomer, and 8.58% $C_{70+}$ oligomer) was formulated with 1.36 parts of a calcium alkylphenate detergent, 5.40 parts alkenyl succinimide ashless dispersant, 1.57 parts alkyl zinc dithiophosphate antioxidant/antiwear additive, 0.30 part thiodiethylene bis-(3,5-di-t-butyl-4-hydroxyhydrocinnamate antioxidant, 0.30 part alkylated phenylnaphthylamine antioxidant, 0.05 part copper deactivator, 0.02 part antifoaming agent (10% silicon in toluene) and 1.00 part overbased calcium sulfonate detergent-/rust inhibitor. The resulting formulated oil had a 100°C. viscosity of 9.30 centistokes and CCS viscosity at −20°C. of 3000 centipoise. The non-polymer thickened oil met all of the SAE J300 JUN87 requirements for 10W-30 oils.

EXAMPLE III

In accordance with the general procedure of Example I, an SAE 10W-30 SF engine oil was obtained using a polyalphaolefin synthetic hydrocarbon basestock without the addition of polymeric viscosity index improvers. The oil contained 92.20 parts polyalphaolefin basestock and 7.80 parts of the API SF gasoline engine performance additive package. Characteristics of the synthetic polyalphaolefin basestock and 100°C. viscosity and CCS viscosity at −20°C. of the resulting formulated engine oil were as follows:

| | |
|---|---|
| Basestock: | |
| 100° C. Kinematic Viscosity | 8.00 |
| Mw | 632.6 |
| % Methyl Hydrogen | 20.1 |
| Oligomer Distribution: | |
| % $C_{30}$ oligomer | 4.1 |
| % $C_{40}$ oligomer | 62.4 |
| % $C_{50}$ oligomer | 19.6 |
| % $C_{60}$ oligomer | 7.0 |
| % $C_{70+}$ oligomer | 7.0 |
| Formulated Engine Oil: | |
| 100° C. Kinematic Viscosity | 9.39 |
| CCS(−20° C.) | 2690 |

The formulation fully met the viscosity requirements of SAE J300 JUN87 for 10W-30 oils.

EXAMPLES IV AND V

Additional non-polymer thickened SAE 10W-30 SF engine oils were prepared using basestock comprised of mixtures of decene-1 oligomers. The basestocks were obtained by blending two polyalphaolefin synthetic hydrocarbon fluids. The first fluid contained 84.9 percent $C_{30}$ oligomer and 14.8 percent $C_{40}$ oligomer. The second fluid was the same as that described in Example I. The API SF performance additive package was also the same as used in Example I and was employed at the same level. Compositions of the engine oils, including the overall oligomer distribution of the resulting synthetic hydrocarbon blends, were as follows:

| | EX. IV | EX. V |
|---|---|---|
| First Hydrocarbon Fluid (Parts) | 18.44 | 11.53 |
| Second Hydrocarbon Fluid (Parts) | 73.76 | 80.68 |
| Properties of Blend: | | |
| 100° C. Kinematic Viscosity | 8.05 | 8.70 |
| Mw | 623.4 | 641.3 |
| % Methyl Hydrogen | 20.9 | 20.9 |
| Oligomer Distribution: | | |
| % $C_{30}$ oligomer | 17.0 | 10.6 |
| % $C_{40}$ oligomer | 46.7 | 49.4 |
| % $C_{50}$ oligomer | 18.6 | 21.3 |
| % $C_{60}$ oligomer | 8.0 | 8.7 |
| % $C_{70+}$ oligomer | 8.6 | 9.4 |

The formulated oil of Example IV had a 100°C. viscosity of 9.31 centistokes and CCS(−20°C.) viscosity of 2810 centipoise. The formulated oil of Example V had a 100°C. viscosity of 10.00 centistokes and CCS(−20°C.) viscosity of 3200 centipoise. Both products met all of the other requirements of SAE J300 to qualify as 10W-30 multigrade oils.

EXAMPLES VI-X

Non-polymer thickened SAE 10W-30 SF/CD universal engine oils suitable for use in both gasoline and diesel engines were prepared. For these formulations, 86.31 parts polyalphaolefin synthetic hydrocarbon basestocks comprised of mixtures of decene-1 oligomers were combined with 13.69 parts performance additive package meeting API SF/CD service requirements [Lubrizol (trademark) 3978]. Characteristics of each basestock and the 100°C. and CCS(−20°C.) viscosities of the resulting formulated engine oils were as follows:

| | EX. VI | EX. VII | E. VIII | EX. IX | EX. X |
|---|---|---|---|---|---|
| Basestock: | | | | | |
| 100° C. Vis | 8.00 | 7.90 | 7.85 | 7.77 | 7.25 |
| $\overline{M}w$ | 634.9 | 633.1 | 630.9 | 626.1 | 606.9 |
| % Me H | 20.2 | 20.1 | 20.05 | 20.0 | 20.3 |
| Oligomer Distr. | | | | | |
| % $C_{30}$ oligomer | 3.8 | 4.0 | 4.3 | 4.8 | 11.7 |
| % $C_{40}$ oligomer | 61.9 | 62.3 | 62.7 | 63.7 | 59.9 |
| % $C_{50}$ oligomer | 19.9 | 19.6 | 19.3 | 18.7 | 17.7 |
| % $C_{60}$ oligomer | 7.2 | 7.1 | 6.9 | 6.3 | 4.7 |
| % $C_{70+}$ oligomer | 7.2 | 7.0 | 6.8 | 6.3 | 4.7 |
| Formulated Engine Oil: | | | | | |
| 100° C. Vis. | 10.36 | 10.25 | 10.14 | 9.92 | 9.39 |
| CCS(−20° C.) | 3400 | 3220 | 3130 | 3270 | 2300 |

EXAMPLES XI AND XII

SAE 15W-40 engine oils suitable for use in diesel engines were prepared which did not contain viscosity index improvers. The basestocks employed were mixtures of hydrogenated oligomers obtained from the oligomerization of decene-1. The amount of basestock and the distribution of decene-1 oligomers in the basestock are set forth below. The amount of the performance additive package employed is also indicated. For the formulation of Example XI, a low ash universal SF/CD performance package [Lubrizol (trademark) 3978] was used whereas the formulation of Example XII employed a high ash premium SF/CD performance package [OLOA 8718 manufactured by Chevron Chemical Company]. Details of the formulations were as follows:

| | EX. XI | EX. XII |
|---|---|---|
| Basestock (Parts): | 86.31 | 83.70 |
| 100° C. Kinematic Viscosity | 9.96 | 9.96 |
| $\overline{M}w$ | 673.3 | 673.3 |
| % Methyl Hydrogen | 21.0 | 21.0 |
| Oligomer Distribution of Blend: | | |
| % $C_{30}$ oligomer | 0 | 0 |
| % $C_{40}$ oligomer | 51.2 | 51.2 |
| % $C_{50}$ oligomer | 27.6 | 27.6 |
| % $C_{60}$ oligomer | 11.7 | 11.7 |

-continued

| | EX. XI | EX. XII |
|---|---|---|
| % $C_{70+}$ oligomer | 9.5 | 9.5 |
| Additive Package (Parts): | 13.69 | 16.30 |
| Formulated Engine Oil: | | |
| 100° C. Kinematic Viscosity | 12.77 | 12.52 |
| CCS(−15° C.) | 2970 | 3380 |

Both oils also met the Borderline Pumping Temperature requirements and all of the other requirements of SAE J300 JUN87 for grade SAE 15W, thus fully qualifying these products as cross-graded 15W-40 SF/CD motor oils without the addition of polymeric viscosity index improvers.

EXAMPLES XIII–XXII

Additional 10W-30 universal engine oils were prepared in accordance with the invention and details are provided in Table I. Four comparative formulations (A-D) which did not qualify as 10W-30 oils are also included. The additive package for all of the formulations was a commercially available SF/CD package used at a 13.69 parts level. Each of the products of Examples XIII–XXII met all of the SAE J300 specifications for 10W-30 oils; however, it is apparent from the data that the 3500 centipoise maximum (CCS at −20°C.) for 10W oils is exceeded with comparative oils A and B due to the fact that the basestock viscosity is outside the specified limits. When the basestock viscosity is within the specified range but the $\overline{M}w$, the %Me H and the oligomer distribution do not meet the required specifications, comparative oils C and D greatly exceed the 3500 centipoise maximum for the −20°C. CCS.

TABLE I

| | EXAMPLE NO. | | | | | | | | | | COMP. | COMP. | COMP. | COMP |
|---|---|---|---|---|---|---|---|---|---|---|---|---|---|---|
| | XIII | XIV | XV | XVI | XVII | XVIII | XIX | XX | XXI | XXII | A | B | C | D |
| Basestock: | | | | | | | | | | | | | | |
| 100° C. Vis | 7.24 | 7.79 | 8.20 | 7.77 | 8.13 | 8.90 | 9.1 | 7.23 | 7.76 | 8.20 | 9.35 | 9.72 | 9.0 | 8.5 |
| $\overline{M}w$ | 608.2 | 635.2 | 641.2 | 649.2 | 655.0 | 667.5 | 671.3 | 685.4 | 736.7 | 747.9 | 674.8 | 680.7 | 773.6 | 761 |
| % Me H | 20.3 | 20.0 | 20.8 | 19.80 | 20.0 | 20.32 | 20.43 | 23.81 | 24.1 | 24.2 | 20.53 | 20.7 | 24.5 | 24.3 |
| Oligomer Distr: | | | | | | | | | | | | | | |
| % $C_{30}$ | 10.4 | 0.2 | 0.2 | 6.4 | 5.6 | 3.8 | 3.3 | 7.5 | 0.4 | 0.3 | 2.8 | 1.9 | 0.16 | 0.24 |
| % $C_{40}$ | 55.2 | 58.1 | 57.2 | 44.0 | 43.7 | 43.1 | 43.0 | 32.5 | 23.5 | 20.1 | 42.8 | 42.5 | 12.4 | 16.1 |
| % $C_{50}$ | 26.6 | 32.5 | 31.5 | 34.2 | 34.2 | 34.1 | 34.1 | 31.5 | 38.2 | 38.7 | 34.1 | 34.1 | 39.8 | 39.3 |
| % $C_{60}$ | 6.3 | 7.6 | 8.0 | 11.7 | 11.7 | 11.8 | 11.8 | 19.4 | 26.0 | 27.5 | 11.9 | 11.9 | 31.0 | 29.3 |
| % $C_{70+}$ | 1.4 | 1.6 | 3.1 | 3.7 | 4.8 | 7.1 | 7.8 | 8.9 | 11.8 | 13.2 | 8.5 | 9.6 | 16.5 | 15.0 |
| Formulated Oil: | | | | | | | | | | | | | | |
| 100° C. Vis. | 9.33 | 10.08 | 10.44 | 10.06 | 10.41 | 11.22 | 11.50 | 9.39 | 10.14 | 10.56 | 11.77 | 12.24 | 11.4 | 10.9 |
| CCS | 2150 | 2550 | 2760 | 2520 | 2730 | 3320 | 3500 | 2550 | 3200 | 3470 | 3770 | 4150 | 4200 | 3750 |

TABLE I-continued

| | EXAMPLE NO. | | | | | | | | | | COMP. | COMP. | COMP. | COMP |
|---|---|---|---|---|---|---|---|---|---|---|---|---|---|---|
| | XIII | XIV | XV | XVI | XVII | XVIII | XIX | XX | XXI | XXII | A | B | C | D |
| (−20° C.) | | | | | | | | | | | | | | |

EXAMPLE XXIII

A 5W-30 universal engine oil containing no viscosity index improver was prepared by blending 86.31 parts synthetic polyalphaolefin basestock with 13.69 parts performance additive package meeting API SF/CD Service Requirements [Lubrizol (trademark) 3968]. The basestock was a mixture of a hydrogenated decene-1 oligomer comprised as follows: 13.17% $C_{30}$ oligomer, 44.50% $C_{40}$ oligomer, 29.69% $C_{50}$ oligomer, 9.69% $C_{60}$ oligomer, and 2.92% $C_{70+}$ oligomer. The oligomer basestock further had a 100°C. kinematic viscosity of 7.2 centistokes, a weight average molecular weight of 559.5 and 20.02% of the hydrogen atoms were methyl hydrogen. The formulated oil had a 100°C. kinematic viscosity of 9.33 and a CCS viscosity at −25°C. of 3500. Additionally, the borderline pumping temperature of the formulated oil was −38.8°C. and the oil met all of the other 5W-30 criteria of SAE J300.

EXAMPLES XXIV-XXXVII

A series of 10W-30 gasoline engine oils were prepared in accordance with the procedure of Example I by confirming a polyalphaolefin basestock with 7.80 parts commercial additive package meeting API SF requirements. Details of the basestock composition and properties of the formulated oil are set forth in Table II.

EXAMPLE XXXVIII

A blended synthetic basestock comprised of a polyalphaolefin and a synthetic ester was utilized to prepare a 10W-30 gasoline (SF) engine oil. To prepare the oil 10 parts of the oligomer mixture used for Example XXXVI was replaced with diisodecyl adipate. In other words, the formulated oil was comprised of 82.20 parts polyalphaolefin, 10 parts diisodecyl adipate and 7.80 parts of the commercial API SF additive package. The resulting formulated oil had a 100°C. kinematic viscosity of 9.3 centistokes, CCS(−20°C.) of 3450 centipoise and met all of the other SAE J300 requirements for a 10W-30 oil.

EXAMPLES XXXIX-XLIV

A series of 15W-40 universal engine oils were prepared by blending 86.31 parts of a mixture of decene-1 oligomers with 13.69 parts commercially universally SF/CD additive package [Lubrizol(trademark) 3978]. Basestock specifications and properties of the resulting formulated oils are set forth in Table III. Two comparative examples (E and F) were also included to demonstrate the inability to obtain 15W-40 oils when all of the specified criteria are not met. For both Comp. E and Comp. F., the minimum 100°C. kinematic viscosity for SAE 40 oils was not met as a result of the viscosities of the basestocks being outside the prescribed range. Additionally, for Comp. E the weight average molecular weight and oligomer specifications were not met.

TABLE II

| | EXAMPLE NO. | | | | | | | | | | | | | |
|---|---|---|---|---|---|---|---|---|---|---|---|---|---|---|
| | XXIV | XXV | XXVI | XXVII | XXVIII | XXIX | XXX | XXXI | XXXII | XXXIII | XXXIV | XXXV | XXXVI | XXXVII |
| Basestock: | | | | | | | | | | | | | | |
| 100° C. Vis. | 7.9 | 8.1 | 9.2 | 9.6 | 8.0 | 8.05 | 8.9 | 9.7 | 7.9 | 8.1 | 9.2 | 8.0 | 8.8 | 9.55 |
| Mw | 635.3 | 641.5 | 672.4 | 683.6 | 640.8 | 642.5 | 665.9 | 685.4 | 643.0 | 649.5 | 682.2 | 650.5 | 674.3 | 693.9 |
| % Me H | 20.9 | 20.9 | 20.9 | 20.9 | 20.1 | 20.1 | 20.5 | 20.8 | 20.3 | 20.3 | 20.2 | 19.8 | 20.0 | 20.1 |
| Oligomer Distr: | | | | | | | | | | | | | | |
| % $C_{30}$ | 19.2 | 17.1 | 6.6 | 2.9 | 0.2 | 0.2 | 0.3 | 0.3 | 20.6 | 18.5 | 7.9 | 2.8 | 2.2 | 1.8 |
| % $C_{40}$ | 38.8 | 39.6 | 43.5 | 44.9 | 56.9 | 56.5 | 51.3 | 47.0 | 31.2 | 31.8 | 34.6 | 48.4 | 42.8 | 31.6 |
| % $C_{50}$ | 22.7 | 23.5 | 27.1 | 28.3 | 32.2 | 32.1 | 30.7 | 29.5 | 27.5 | 28.4 | 32.8 | 35.1 | 35.3 | 30.9 |
| % $C_{60}$ | 8.1 | 8.4 | 9.7 | 10.2 | 7.9 | 8.0 | 9.2 | 10.2 | 8.1 | 11.0 | 12.7 | 9.9 | 11.7 | 13.1 |
| % $C_{70+}$ | 10.9 | 11.3 | 13.0 | 13.7 | 2.9 | 3.2 | 8.5 | 12.9 | 10.9 | 10.3 | 11.9 | 3.7 | 8.0 | 11.2 |
| Formulated Oil: | | | | | | | | | | | | | | |
| 100° C. Vis | 9.3 | 9.47 | 10.68 | 11.2 | 9.30 | 9.41 | 10.34 | 11.25 | 9.30 | 9.48 | 10.68 | 9.30 | 10.24 | 11.14 |
| CCS (−20° C.) | 2210 | 2350 | 3090 | 3500 | 2400 | 2250 | 2870 | 3400 | 2110 | 2230 | 2930 | 2100 | 2780 | 3360 |

TABLE III

| | EXAMPLE NO: | | | | | | | |
|---|---|---|---|---|---|---|---|---|
| | XXXIX | XL | XLI | XLII | XLIII | XLIV | COMP. E | COMP. F |
| Basestock: | | | | | | | | |
| 100° C. Vis. | 9.93 | 10.46 | 11.78 | 9.90 | 10.53 | 9.89 | 9.66 | 9.72 |
| Mw | 691.0 | 704.8 | 741. | 701.8 | 718.0 | 797.5 | 668.1 | 680.7 |
| % Me H | 20.9 | 21.0 | 20.7 | 20.2 | 20.2 | 24.7 | 21.0 | 20.2 |
| Oligomer Distr: | | | | | | | | |
| % $C_{30}$ | 0.4 | 0.2 | 0 | 1.6 | 1.0 | 0 | 0.4 | 1.9 |
| % $C_{40}$ | 45.8 | 40.8 | 30.5 | 36.3 | 31.0 | 5.0 | 52.9 | 42.5 |
| % $C_{50}$ | 29.2 | 31.4 | 35.2 | 35.5 | 38.0 | 40.9 | 27.2 | 34.1 |
| % $C_{60}$ | 10.5 | 11.8 | 15.0 | 13.7 | 15.4 | 34.4 | 9.5 | 11.9 |

TABLE III-continued

| | EXAMPLE NO: | | | | | | | |
|---|---|---|---|---|---|---|---|---|
| | XXXIX | XL | XLI | XLII | XLIII | XLIV | COMP. E | COMP. F |
| % $C_{70+}$ | 14.1 | 15.8 | 19.3 | 12.9 | 14.6 | 19.7 | 10.0 | 9.6 |
| Formulated Oil: | | | | | | | | |
| 100° C. Vis. | 12.55 | 13.11 | 14.4 | 12.5 | 13.23 | 12.57 | 12.24 | 12.26 |
| CCS(−15° C.) | 2700 | 2880 | 3500 | 2560 | 2800 | 3300 | 2570 | 2500 |

EXAMPLE XLV

A 15W-40 universal engine oil was prepared by blending 10 parts di-2-ethylhexyl adipate, 76.31 parts of a polyalphaolefin obtained by oligomering decene-1 1.0% $C_{30}$, 31.0% $C_{40}$, 38.0% $C_{50}$, 15.4% $C_{60}$ and 14.6% $C_{70+}$) and 13.69 parts commercial API SF/CD additive package. The resulting formulated oil had a 100°C. kinematic viscosity of 12.8 centistokes, CCS(−15°C.) of 3000 centipoise and met all of the other SAE J300 requirements for a 15W-40 oil.

EXAMPLES XLVI–XLIX

Another series of 15W-40 universal engine oils were prepared by blending 83.70 parts mixed decene-1 oligomers with 16.30 parts commercial high-ash universal SF/CD additive package (CHEVRON OLOA 8718). Basestock specifications and properties of the resulting formulated oils are identified in Table IV. Two comparative products (G and H) were included to further demonstrate that when all of the specified criteria are not met it is not possible to obtain multigrade oils which meet the requirements of SAE J300 for 15W-40 oils. For both G and H the 100°C. minimum kinematic viscosity for SAE 40 oils is not met since the 100°C. basestock viscosity is outside the prescribed range. For Comp. G the weight average molecular weight and oligomer distribution are also outside the specified limits.

TABLE IV

| | EXAMPLE NO. | | | | | |
|---|---|---|---|---|---|---|
| | XLVI | XLVII | XLVIII | XLIX | COMP. G | COMP. H |
| Basestock: | | | | | | |
| 100° C. Vis. | 9.93 | 10.46 | 9.90 | 10.53 | 9.66 | 9.72 |
| Mw | 691.0 | 704.8 | 701.8 | 718.0 | 668.1 | 680.7 |
| % Me H | 20.9 | 21.0 | 20.2 | 20.2 | 21.0 | 20.7 |
| Oligomer Distr: | | | | | | |
| % $C_{30}$ | 0.4 | 0.2 | 1.6 | 1.0 | 0.4 | 1.9 |
| % $C_{40}$ | 45.8 | 40.8 | 36.3 | 31.0 | 52.9 | 42.5 |
| % $C_{50}$ | 29.2 | 31.4 | 35.5 | 38.0 | 27.2 | 34.1 |
| % $C_{60}$ | 10.5 | 11.8 | 13.7 | 15.4 | 9.5 | 11.9 |
| % $C_{70+}$ | 14.1 | 15.8 | 12.9 | 14.6 | 10.01 | 9.6 |
| Formulated Oil: | | | | | | |
| 100° C. Vis. | 12.56 | 13.17 | 12.52 | 13.29 | 12.32 | 12.29 |
| CCS (−15° C.) | 3200 | 3510 | 3030 | 3380 | 3010 | 2900 |

We claim:

1. In an SAE 10W-30 universal engine oil formulated to meet API "C" Service Requirements or API "S" and "C" Service Requirements containing 80% to 90% by weight of a hydrogenated decene-1 oligomer basestock having a 100°C. kinematic viscosity of 7.2 to 9.1 centistokes and 10% to 20% by weight performance additives, to produce an engine oil free of polymeric viscosity index improvers, the improvement wherein the oligomer basestock is a mixture comprising 0.2% to 13.5% $C_{30}$ oligomer, 20% to 64% $C_{40}$ oligomer, 17% to 39% $C_{50}$ oligomer, 6% to 27.5% $C_{60}$ oligomer and 1% to 13.5% $C_{70+}$ oligomers, said ogligomers having a weight average molecular weight from 559 to 750 with 19.8% to 24.2% of the hydrogen atoms of said oligomers being methyl hydrogens.

2. The improved SAE 10W-30 universal engine oil of claim 1 wherein the weight average molecular weight of the oligomer mixture is 560 to 672 and the percentage of methyl hydrogens ranges from 19.8 to 20.5.

3. The improved SAE 10W-30 universal engine oil of claim 1 wherein the oligomer mixture is comprised of 3% to 13% $C_{30}$ oligomer, 42% to 44.5% $C_{40}$ oligomer, 29% to 34.5% $C_{50}$ oligomer, 9.5% to 12% $C_{60}$ oligomer and 2.5% to 8% $C_{70+}$ oligomers.

4. The improved SAE 10W-30 universal engine oil of claims 1, 2, or 3 which meets the requirements of API Service Category CE.

5. The improved SAE 10W-30 universal engine oil of claims 1, 2, or 3 which meets the requirements of API Service Categories SG and CE.

6. In an SAE 10W-30 universal engine oil formulated to meet API "C" Service Requirements of API "S" and "C" Service Requirements containing 10% to 20% by weight performance additives and 80% to 90% by weight of a synthetic basestock having a 100°C. kinematic viscosity of 7.2 to 9.1 centistokes and consisting of 70% to 95% by weight of a hydrogenated decene-1 oligomer basestock and 5% to 30% by weight of a synthetic ester basestock selected from the group consisting of esters of adipic acid or azelaic acid with $C_{8-13}$ monofunctional aliphatic alcohols and esters of $C_{5-10}$ aliphatic monocarboxylic acids with trimethylolpropane or pentaerythritol, to produce an engine oil free of polymeric viscosity index improvers, the improvement wherein the oligomer basestock is a mixture comprising 0.2% to 13.5% $C_{30}$ oligomer, 20% to 64% $C_{40}$ oligomer, 178% to 39% $C_{50}$ oligomer, 6% to 27.5% $C_{60}$ oligomer and 1% to 13.5% $C_{70+}$ oligomers, said oligomers having a weight average molecular weight from 559 to 750 with a 19.8% to 24.2% of the hydrogen atoms of said oligomers being methyl hydrogens.

7. The improved SAE 10W-30 universal engine oil of claim 6 wherein the weight average molecular weight of the oligomer mixture is 560 to 672, the percentage of methyl hydrogens ranges from 19.8 to 20.5 and the oligomer mixture is comprised of 3% to 13% $C_{30}$ oligomer, 42% to 44.5% $C_{40}$ oligomer, 29% to 34.5% $C_{50}$ oligomer, 9.5% to 12% to 12% $C_{60}$ oligomer and 2.5% to 8% $C_{70+}$ oligomers.

8. The improved SAE 10W-30 universal engine oil of claim 6 wherein the synthetic ester constitutes from 5% to 15% by weight of the synthetic basestock and is a diester of adipic acid or azelaic acid with isodecyl alcohol, isotridecyl alcohol or 2-ethylhexanol.

9. The improved SAE 10W-30 universal engine oil of claims 6, 7, or 8 which meets the requirements of API Service Category CE.

10. The improved SAE 10W-30 universal engine oil of claims 6, 7 or 8 which meets the requirements of API Service Categories SG and CE.

11. In an SAE 10W-30 gasoline engine oil formulated to meet API "S" Service Requirements containing 90% to 95% by weight of a hydrogenated decene-1 oligomer basestock having a 100°C. kinematic viscosity of 7.9 to 9.9 centistokes and 5% to 10% by weight performance additives, to produce an engine oil free of polymeric viscosity index improvers, the improvement wherein the oligomer basestock is a mixture comprising 0.2% to 21% $C_{30}$ oligomer, 31% to 62.5% $C_{40}$ oligomer, 18% to 35.5% $C_{50}$ oligomer, 7% to 14% $C_{60}$ oligomer and 2.5% to 14% $C_{70+}$ oligomers, said oligomers having a weight average molecular weight from 623 to 702 with 19.8% to 20.9% of the hydrogen atoms of said oligomers being methyl hydrogens.

12. The improved SAE 10W-30 gasoline engine oil of claim 11 wherein the average molecular weight of the oligomer mixture is 643 to 702 and the percentage of methyl hydrogens ranges from 19.8 to 20.3.

13. The improved SAE 10W-30 gasoline engine oil of claim 11 wherein the oligomer mixture is comprised of 1.5% to 20.5% $C_{30}$ oligomer, 31% to 48.5% $C_{40}$ oligomer, 27.5% to 35.5% $C_{50}$ oligomer, 8% to 14% $C_{60}$ oligomer and 3% to 13% $C_{70+}$ oligomers.

14. The improved SAE 10W-30 gasoline engine oil of claims 11, 12, or 13 which meets the requirements of API Service Category SG.

15. In an SAE 10W-30 gasoline engine oil formulated to meet API "S" Service Requirements containing 5% to 10% by weight performance additives and 90% to 95% by weight of a synthetic basestock having a 100°C. kinematic viscosity of 7.9 to 9.9 centistokes and consisting of 70% to 95% by weight of a hydrogenated decene-1 oligomer basestock and 5% to 30% by weight of a synthetic ester basestock selected from the group consisting of esters of adipic acid or azelaic acid with $C_{8-13}$ monofunctional aliphatic alcohols and esters of $C_{5-10}$ aliphatic monocarboxylic esters with trimethylolpropane or pentaerythritol, to produce a engine oil free of polymeric viscosity index improvers, the improvement wherein the oligomer basestock is a mixture comprising 0.2% to 21% $C_{30}$ oligomer, 31% to 62.5% $C_{40}$ oligomer, 18% to 35.5% $C_{50}$ oligomer, 7% to 14% $C_{60}$ oligomer and 2.5% to 14% $C_{70+}$% oligomers, said oligomers having a weight average molecular weight from 623 to 702 with 19.8% to 20.9% of the hydrogen atoms of said oligomers being methyl hydrogens.

16. The improved SAE 20W-30 gasoline engine oil of claim 15 wherein the average molecular weight of the oligomer mixture is 643 to 702, the percentage of methyl hydrogens ranges from 19.8 to 20.3 and the oligomer mixture is comprised of 1.5% to 20.5% $C_{30}$ oligomer, 31% to 48.5% $C_{40}$ oligomer, 27.5% to 35.5% $C_{50}$ oligomer, 8% to 14% $C_{60}$ oligomer and 3% to 13% $C_{70+}$ oligomers.

17. The improved SAE 10W-30 gasoline engine oil of claim 15 wherein synthetic ester constitutes from 5% to 15% by weight of the synthetic basestock and is a diester of adipic acid or azelaic acid with isodecyl alcohol, isotridecyl alcohol or 2-ethylhexanol.

18. The improved SAE 10W-30 gasoline engine oil of claims 15, 16, or 17 which meets the guidelines of API Service Category SG.

19. In an SAE 15W-40 universal engine oil formulated to meet API "C" Service Requirements or API "S" and "C" Service Requirements containing 80% to 90% by weight of a hydrogenated decene-1 oligomer basestock having a 100°C. kinematic viscosity of 9.9 to 11 centistokes and 10% to 20% by weight performance additives, to produce an engine oil free of polymeric viscosity index improvers, the improvement wherein the oligomer basestock is a mixture comprising up to 2% $C_{30}$ oligomer, 5% to 51.5% $C_{40}$ oligomer, 27% to 44.5% $C_{50}$ oligomer, 10.5% to 34.5% $C_{60}$ oligomer and 9.5% to 20% $C_{70+}$ oligomers, said oligomers having a weight average molecular weight from 673 to 798 with a 20.2% to 24.7% of the hydrogen atoms of said oligomers being methyl hydrogens.

20. The improved SAE 15W-40 universal engine oil of claim 19 wherein the weight average molecular weight is 680 to 720 and the percentage of methyl hydrogens ranges from 20.2 to 21.

21. The improved SAE 15W-40 universal engine oil of claim 19 wherein the oligomer mixture is comprised of 0.1% to 1.9% $C_{30}$ oligomer, 18.5% to 42.5% $C_{40}$ oligomer, 29% to 44.5% $C_{50}$ oligomer, 11.5% to 19% to $C_{60}$ oligomer and 9.5% to 18% $C_{70+}$ oligomer.

22. The improved SAE 15W-40 universal engine oil of claims 19, 20, or 21 which meets the requirements of API Service Category CE.

23. The improved SAE 15W-40 universal engine oil of claims 19, 20, or 21 which meets the requirements of API Service Categories SG and CE.

24. In an SAE 15W-40 universal engine oil formulated to meet API "C" Service Requirements or API "S" and "C" Service Requirements containing 10% to 20% by weight performance additives and 80% to 90% by weight of a synthetic basestock having a 100°C. kinematic viscosity of 9.9 to 11 centistokes and consisting of 70% to 95% by weight of a hydrogenated decene-1 oligomer basestock and 5% to 30% by weight of a synthetic ester basestock selected from the group consisting of esters of adipic acid or azelaic acid with $C_{8-13}$ aliphatic alcohols and esters of $C_{5-10}$ aliphatic monocarboxylic acids with trimethylolpropane or pentaerythritol, to produce an engine oil free of polymeric viscosity index improvers, the improvement wherein the oligomer basestock is a mixture comprising up to 2% $C_{30}$ oligomer, 5% to 51.5% $C_{40}$ oligomer, 27% to 44.5% $C_{50}$ oligomer, 10.5% to 34.5% $C_{60}$ oligomer and 9.5% to 20% $C_{70+}$ oligomers; and said hydrogenated decene-1 oligomer mixture having a weight average molecular weight of 673 to 798 with 20.2% to 24.7% of the hydrogen atoms of the oligomers being methyl hydrogens.

25. The improved SAE 15W-40 universal engine oil of claim 24 wherein the weight average molecular weight of the oligomer mixture is 680 to 720, the percentage of methyl hydrogens ranges from 20.2 to 21 and the oligomer mixture is comprised of 0.1% to 1.9% $C_{30}$ oligomer, 18.5% to 42.5% oligomer, 29% to 44.5% $C_{50}$ oligomer, 11.5% to 19% $C_{60}$ oligomer and 9.5% to 18% $C_{70+}$ oligomers.

26. The improved SAE 15W-40 universal engine oil of claim 25 wherein synthetic ester constitutes from 5% to 15% by weight of the synthetic basestock and is a diester of adipic acid or azelaic acid with isodecyl alcohol, isotridecyl alcohol or 2-ethylhexanol.

27. The improved SAE 15W-40 universal engine oil of claims 24, 25, and 26 which meets the requirements of API Service Category CE.

28. The improved SAE 15W-40 universal engine oil of claims 24, 25, and 26 which meets the requirements of API Service Categories SG and CE.

29. In an SAE 5W-30 universal engine oil formulated to meet API "C" Service Requirements or API "S" and "C" Service Requirements containing 80% to 90% by weight of a hydrogenated decene-1 oligomer basestock having a 100°C. kinematic viscosity of 7.1 to 7.3 and 10% to 20% by weight performance additives, to produce an engine oil free of polymeric viscosity index improvers, the improvement wherein the oligomer basestock is a mixture comprising 12.5% to 13.5% $C_{30}$ oligomer, 43% to 47% $C_{40}$ oligomer, 28.5% to 30.5% $C_{50}$ oligomer, 9% to 10% $C_{60}$ oligomer and 2.4% to 3.5% $C_{70+}$ oligomers, said oligomers having a weight average molecular weight from 550 to 570 with 19.8% to 20.2% of the hydrogen atoms of the oligomers being methyl hydrogens.

* * * * *